US008308033B2

(12) United States Patent
Case et al.

(10) Patent No.: US 8,308,033 B2
(45) Date of Patent: Nov. 13, 2012

(54) SELF-ADJUSTING HOLSTER PARTICULARLY ADAPTED FOR HOLDING IMPLEMENTS OF A WIDE RANGE OF SIZES

(75) Inventors: Richard N. Case, Boulder, CO (US); Dennis Balchunas, Boulder, CO (US)

(73) Assignee: Nite Ize, Inc., Boulder, CO (US)

( * ) Notice: Subject to any disclaimer, the term of this patent is extended or adjusted under 35 U.S.C. 154(b) by 870 days.

(21) Appl. No.: 12/327,563

(22) Filed: Dec. 3, 2008

(65) Prior Publication Data

US 2009/0140016 A1 Jun. 4, 2009

Related U.S. Application Data

(60) Provisional application No. 60/992,005, filed on Dec. 3, 2007.

(51) Int. Cl.
*F41C 33/02* (2006.01)

(52) U.S. Cl. ..... 224/200; 224/197; 224/247; 224/250; 224/914

(58) Field of Classification Search ..... 224/148.5, 224/197, 250, 911, 930, 200, 247, 251, 914
See application file for complete search history.

(56) References Cited

U.S. PATENT DOCUMENTS 1,318,850 A * 10/1919 de Yong ..... 362/396
2,500,257 A 3/1950 Mahan
4,197,890 A * 4/1980 Simko ..... 383/97
4,846,383 A * 7/1989 Gallagher ..... 224/243
5,065,847 A * 11/1991 Hsieh ..... 190/125
5,217,151 A * 6/1993 Parsons ..... 224/672
5,351,868 A * 10/1994 Beletsky et al. ..... 224/245
D352,823 S * 11/1994 Chapman et al. ..... D3/220
5,412,545 A 5/1995 Rising
5,431,318 A * 7/1995 Garcia ..... 224/192
5,570,830 A * 11/1996 Nichols ..... 224/676
5,620,120 A * 4/1997 Tien ..... 224/199
5,653,367 A * 8/1997 Abramson ..... 224/581
5,964,386 A 10/1999 Cote
6,056,174 A 5/2000 Minckler
6,082,602 A * 7/2000 Gschwind ..... 224/682
D437,111 S * 2/2001 Bergh ..... D3/218
6,370,401 B1 4/2002 Baranowski et al.
6,412,674 B1 * 7/2002 Lipke ..... 224/240
6,454,146 B2 * 9/2002 Alis ..... 224/250
6,568,576 B1 * 5/2003 Godshaw et al. ..... 224/647
6,641,015 B2 * 11/2003 Huggins, Jr. ..... 224/674
D503,039 S * 3/2005 Cook et al. ..... D3/229
6,915,934 B2 7/2005 Hassett
D532,199 S 11/2006 Balchunas et al.
D539,031 S 3/2007 Balchunas et al.
D549,958 S 9/2007 Boyd et al.
D550,954 S 9/2007 Boyd et al.
D550,955 S 9/2007 Boyd et al.
7,389,899 B2 * 6/2008 Johnson ..... 224/675

(Continued)

*Primary Examiner* — Justin Larson
*Assistant Examiner* — John Cogill
(74) *Attorney, Agent, or Firm* — Patton Boggs LLP

(57) ABSTRACT

An implement holster comprising a holster support, a first cradle attached to the holster support, a second cradle, and a resilient strap system connected between the holster support and the second cradle, the first cradle fitting within the second cradle. The implement holster further comprises a clip adapted for attaching the holster to a support, a rotator connected between the clip and the holster, and a detent system permitting the holster to be held in a plurality of different positions with respect to the clip.

14 Claims, 6 Drawing Sheets

U.S. PATENT DOCUMENTS

| | | | | |
|---|---|---|---|---|
| 7,513,472 | B2 * | 4/2009 | Yang | 248/231.81 |
| 7,845,527 | B1 * | 12/2010 | McMillan et al. | 224/232 |
| 2001/0022161 | A1 * | 9/2001 | Macedo et al. | 119/796 |
| 2004/0085694 | A1 | 5/2004 | Germagian et al. | |
| 2004/0206796 | A1 * | 10/2004 | Badillo et al. | 224/577 |
| 2005/0023186 | A1 | 2/2005 | Hassett | |
| 2006/0058081 | A1 | 3/2006 | Reichenbach | |
| 2007/0068982 | A1 * | 3/2007 | Grundy et al. | 224/236 |

* cited by examiner

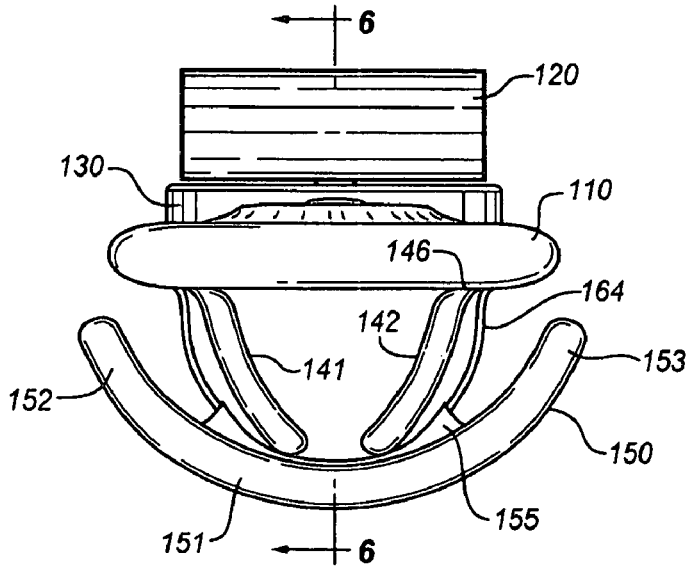
FIG. 5
FIG. 6
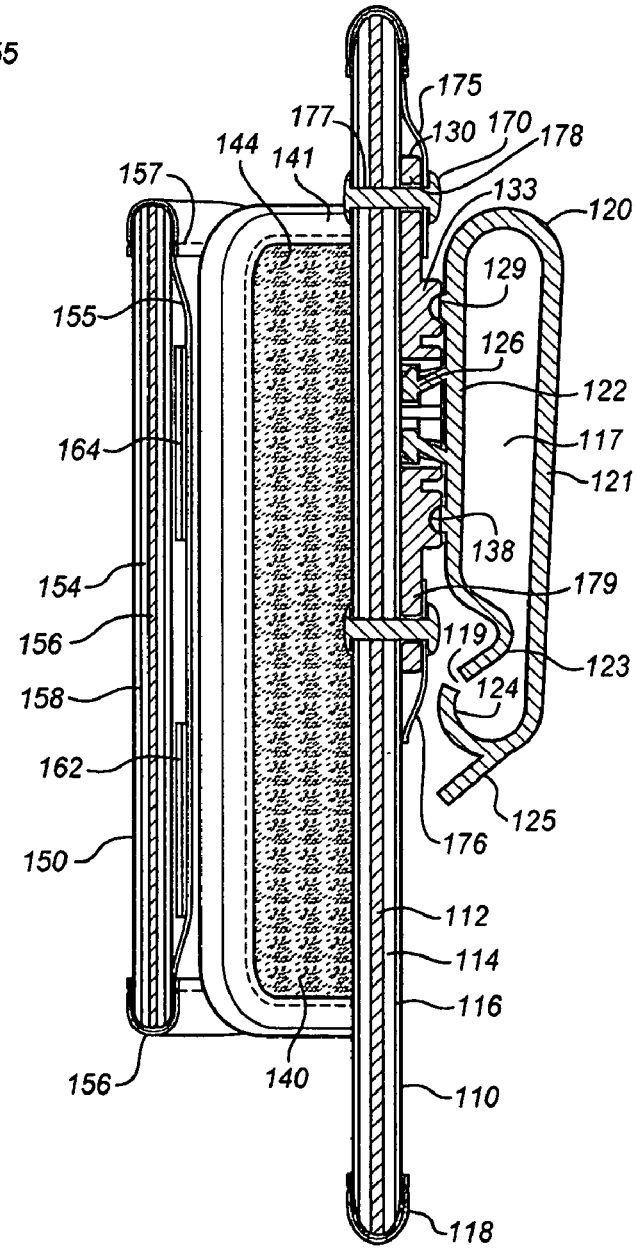

SELF-ADJUSTING HOLSTER PARTICULARLY ADAPTED FOR HOLDING IMPLEMENTS OF A WIDE RANGE OF SIZES

CROSS-REFERENCE TO RELATED APPLICATIONS

This Application claims the benefit of Provisional Application No. 60/992005 filed on Dec. 3, 2007 titled "Self-Adjusting Tool Holster Particularly Adapted For Holding Flashlights Of A Wide-Range Of Sizes", the entire disclosure of which is hereby incorporated by reference.

FIELD OF THE INVENTION

The invention relates generally to the field of holsters, and more particularly to a implement holster that is expandable so that it can hold implements of a wide range of different sizes.

BACKGROUND OF THE INVENTION

Implement holsters, and particularly flashlight holsters, are well known in the art. It has long been recognized that flashlight holsters should be adjustable for a variety of different size flashlights and/or be able to hold the flashlight to a belt or headband in a variety of positions so that the flashlight can be used hands free. See, for example, U.S. Pat. No. 2,500,257 issued to Arthur T. Mahan on Aug. 1, 1947 and U.S. Pat. No. 5,412,545 issued to Brett Rising on May 2, 1995. However, either the adjustments require relatively complex operations, or the holder does not hold the flashlight or other implement firmly. However, present-day flashlights come in a wide variety of sizes, from flashlights holding AAA-size batteries to flashlights holding D-size batteries. Most households have several sizes of flashlights, and often the user will have a need for a flashlight quickly, such that there is, at least in the head of the user, no time to adjust a holster and put it on. Thus, most people do not use flashlight holsters, but rather simply hold the flashlight in their hands. Moreover, because of the great variety of different implements and sporting goods items, most stores that carry flashlight, tool, and other implement holsters do not have room to stock a wide variety of holster sizes. Thus, it would be desirable to have an implement holder that automatically adjusts when the implement is inserted and is capable of holding implements of all the standard sizes. In the case of a flashlight, if this holster was also able to hold the flashlight so that it could be aimed and used in a hands-free manner, such a holster would be highly desirable.

BRIEF SUMMARY OF THE INVENTION

The invention solves the above problems, as well as other problems of the prior art, by providing an implement holster, such as a tool or flashlight holster, in which the act of inserting the implement automatically adjusts the holster to the size of the implement.

The invention solves the above problems by providing a plurality of flexible cradles that entrap the implement while conforming to the shape of the implement. Preferably, resilient straps pull the cradles together, entrapping the implement between the cradles. Preferably, one cradle fits inside the other, and the resilient straps are attached to the outer cradle.

The invention also solves the above problems by attaching the holster to a clip by a rotator with detents. The clip allows the holster to be attached to a support, such as a belt, and the rotator and detents allow the holster, and the implement inserted into it, to be aimed in any one of, for example, eight different directions.

The invention provides an implement holster comprising: a holster support, a first cradle attached to the holster support, a second cradle and a resilient strap system connected between the holster support and the second cradle, the first cradle fitting within the second cradle. Preferably, the first cradle comprises a first arm and a second arm, the first and second arms attached to the holster supported via a hinge. Preferably, the hinge is a fabric hinge. Preferably, the first cradle comprises a solid core, a molded shell, and a fabric cover; and the hinge is formed by the fabric cover. Preferably, the second cradle comprises a first second cradle arm and a second second cradle arm, the first and second arms being connected at their proximal ends; and the resilient strap system comprises a resilient strap connected between the second cradle and the holster support. Preferably, the resilient strap system includes a resilient strap connected between the holster support and the second cradle. Preferably, the resilient strap passes along the outside surface of the first cradle. Preferably, the holster support comprises a solid core, a molded shell, and a fabric cover. Preferably, the implement holster further comprises a clip adapted for attaching the holster to a support. Preferably, the clip includes a loop area through which a belt, pants waistband, or other clothing or support member can pass to attach the holster to a person or other object. Preferably, the implement holster further comprises a rotator connected between the clip and the holster. Preferably, the implement holster further comprises a detent system permitting the holster to be held in a plurality of different positions with respect to the clip. Preferably, the second cradle comprises a solid core, a molded shell, and a fabric cover. Preferably, the interior fabric of the second cradle is made of a soft, smooth fabric while the exterior fabric of the second cradle is a rugged fabric. Preferably, the exterior fabric is a woven fabric. Preferably, the interior surface of the first cradle is formed out of a soft, smooth fabric.

The invention also provides a method of holding an implement, the method comprising: providing a holster support, a first cradle, and a second cradle, with the first cradle connected to the support; inserting the implement between the cradles; and pulling the second cradle toward the holster support to grasp the implement between the cradles. Preferably, the implement includes a clip and a rotator mechanism, and the implement is a flashlight; and further comprising clipping the holster support to an object and rotating the flashlight to aim the flashlight beam without moving the object. Preferably, the pulling is performed by an elastic band connected between the holster support and the second cradle. Preferably, the method further comprises adjusting the size of the cradles during the pulling whereby implements of a variety of sizes may be grasped.

The invention provides a holster that self-adjusts to the implement put into it and at the same time grips the implement robustly. For example, it adjusts to nearly any conventionally-sized flashlight and at the same time allows the flashlight to be aimed and used hands free. Numerous other features, objects, and advantages of the invention will become apparent from the following description when read in conjunction with the accompanying drawings.

BRIEF DESCRIPTION OF THE DRAWINGS

FIG. 5 is top plan view of the implement holster of FIG. 1;

FIG. 6 is a cross-section of the implement holster of FIG. 1 taken through the line 6-6 of FIG. 5;

DETAILED DESCRIPTION OF THE INVENTION

Figure 1:
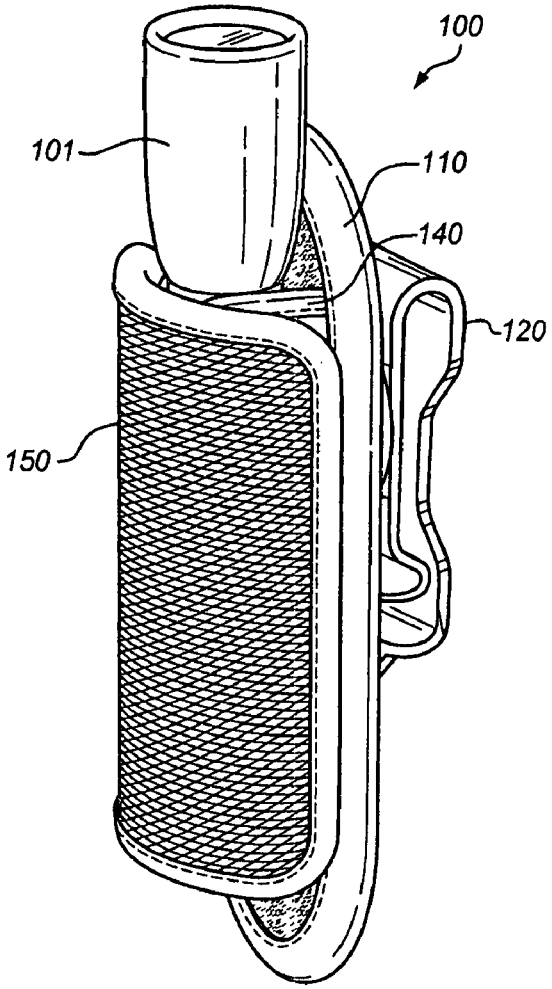
FIG. 1 is a right-front perspective view of an exemplary embodiment of the implement holster according to the invention with a AAA-cell flashlight inserted in it.

For the purposes of promoting an understanding of the principles of the invention, reference will now be made to the embodiment illustrated in the drawings and described in the following. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains. It should also be understood that, in accordance with the patent law, the drawings are not intended to be precise engineering drawings of the invention, but rather are only intended to illustrate the invention. For example, the scale of the drawings and relative size of the various parts are generally altered so as to better illustrate the invention within the constraints of a written document such as this. In particular, while this application is disclosed in combination with a flashlight, it should be understood that any implement can be substituted for the flashlight. For example, hand tools, small garden tools, spray cans, and ammunition are some of the implements for which this holster has been used for during its test period.

Figure 7:
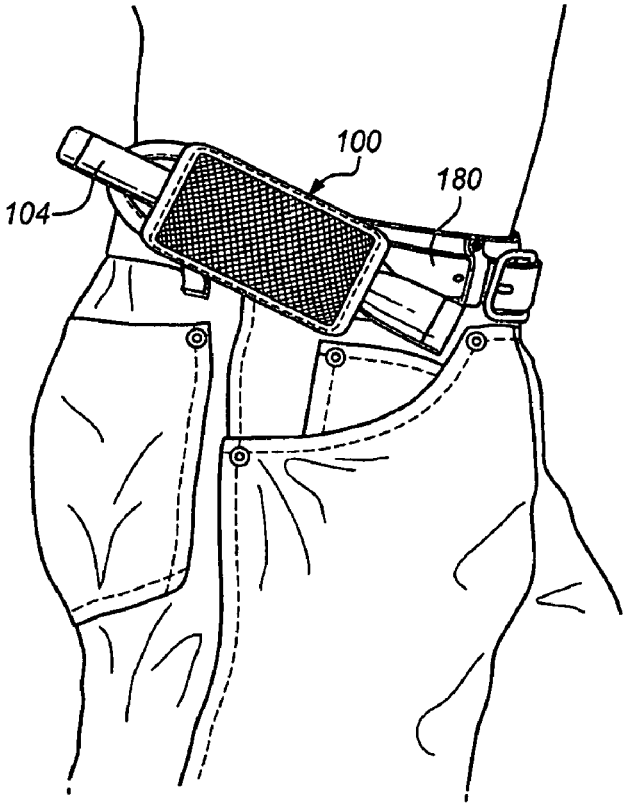
FIG. 7 illustrates the holster of FIG. 1 with a AA-cell flashlight inserted with the flashlight in a forward pointing position with respect to the belt clip.
Figure 8:
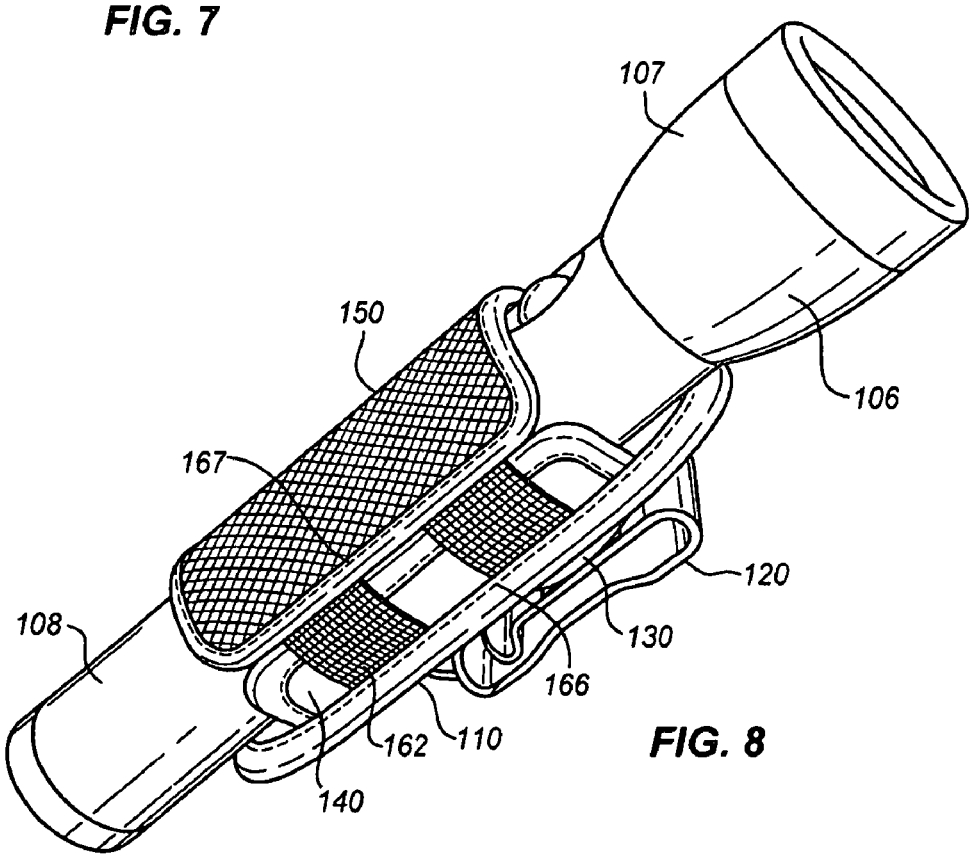
FIG. 8 illustrates the holster of FIG. 1 with a D-cell size flashlight inserted with the flashlight pointing upward with respect to the belt clip.

The figures illustrate an exemplary embodiment of an implement holster 100 according to the invention. FIGS. 1-4 illustrate the implement holster 100 with a AAA-cell flashlight 101 inserted in it; FIG. 7 illustrates the holster with a AA-cell flashlight inserted in it; and FIG. 8 illustrates the same holster with a D-cell flashlight 106 inserted in it. All three flashlights are conventional flashlights having a tubular body 103 and 108, respectively, and an enlarged head 102 and 107, respectively. As can be seen from these figures, the AAA-cell flashlight, the AA-cell flashlight, and the D-cell flashlight each are firmly held and supported so it is secured in a manner that does not require frequent attention to keep it secured. Further, all three flashlights can be aimed in a variety of directions while being worn, and will stay pointing in the direction aimed, so it can be used hands free.

Figure 2:
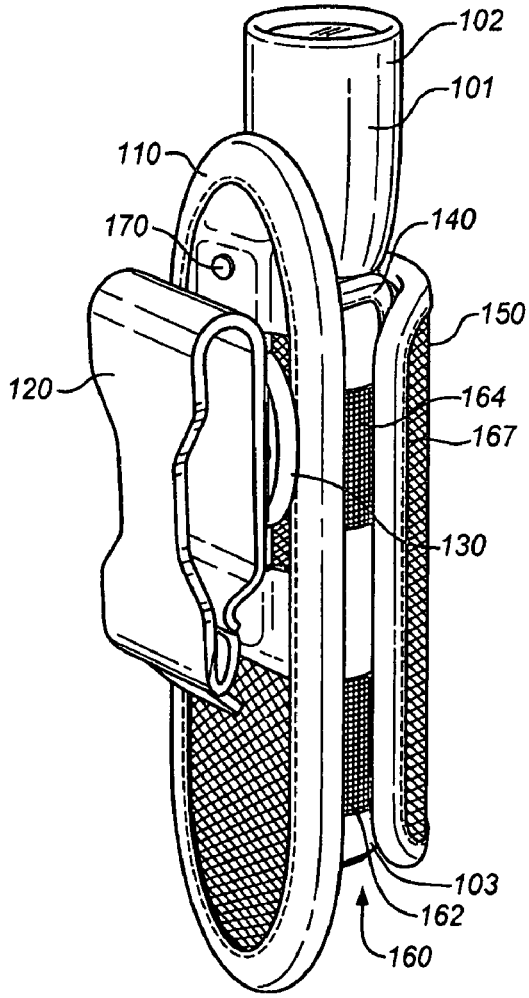
FIG. 2 is a left-rear perspective view of the implement holster of FIG. 1 with the AAA-cell flashlight inserted in it.

FIG. 1 is a right-front perspective view of an exemplary embodiment of the implement holster 100, and FIG. 2 is a left-rear perspective view of the implement holster. Holster 100 comprises a holster support 110, a clip 120, a rotator 130 connected between support 110 and clip 120, a first cradle 140, and a second cradle 150. In this discussion, the longitudinal direction is a direction parallel to the long length of flashlight body 103, 108, and the circumferential direction is a circular direction parallel to the cylinder of the flashlight body 103, 108. First cradle 140 is connected directly to support 110, while second cradle 150 is attached to support 110 by a resilient strap system 160. In this exemplary embodiment, resilient strap system 160 includes a first resilient strap 162 and a second resilient strap 164. Cradles 140 and 150 preferably extend along straps 162 and 164 and are preferably essentially equally spaced from the ends of second cradle 150 so as to exert a uniform compression force on flashlight body 103, 108 along cradle 150.

Figure 3:
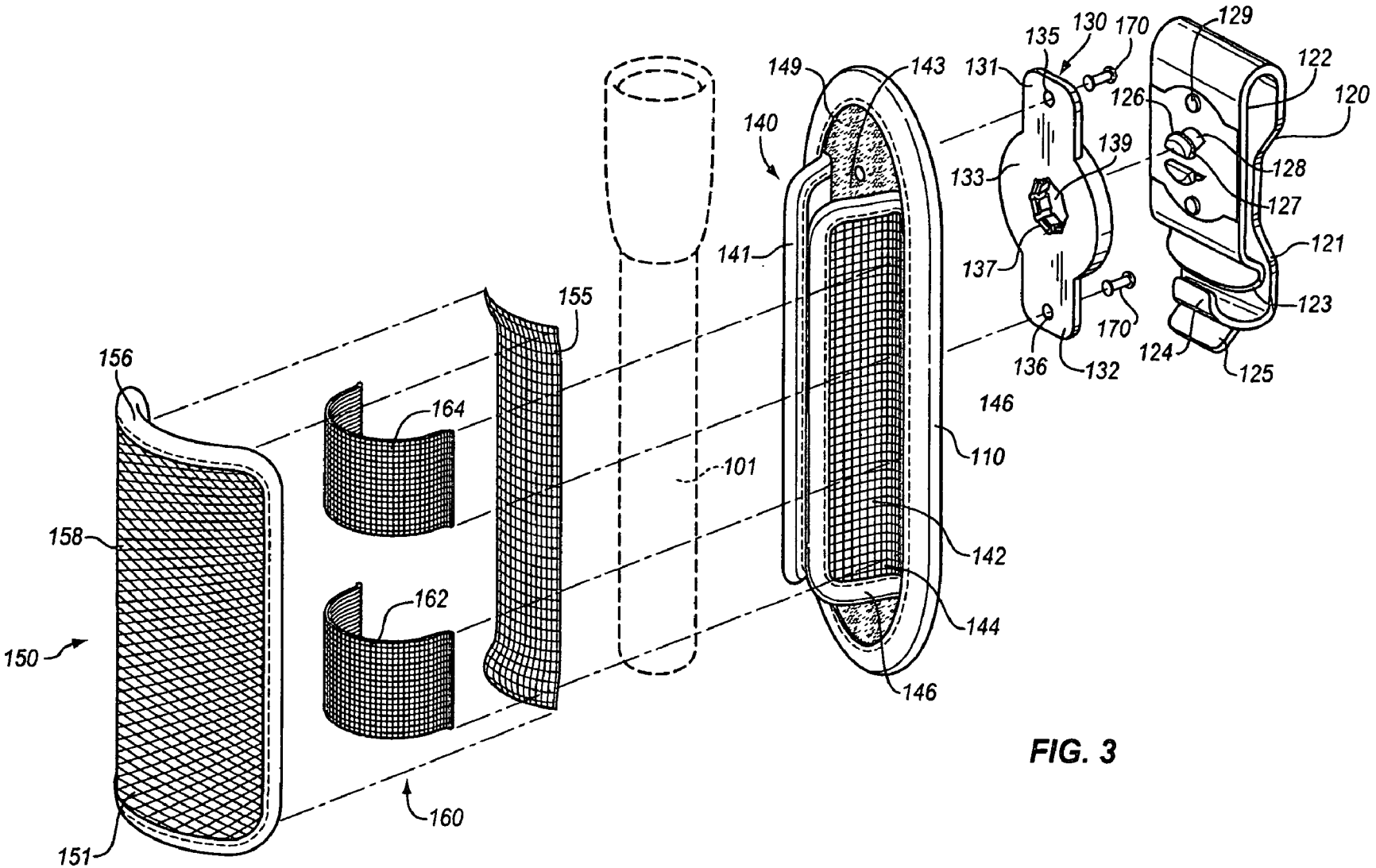
FIG. 3 is right-front exploded view of the implement holster of FIG. 1.
Figure 4:
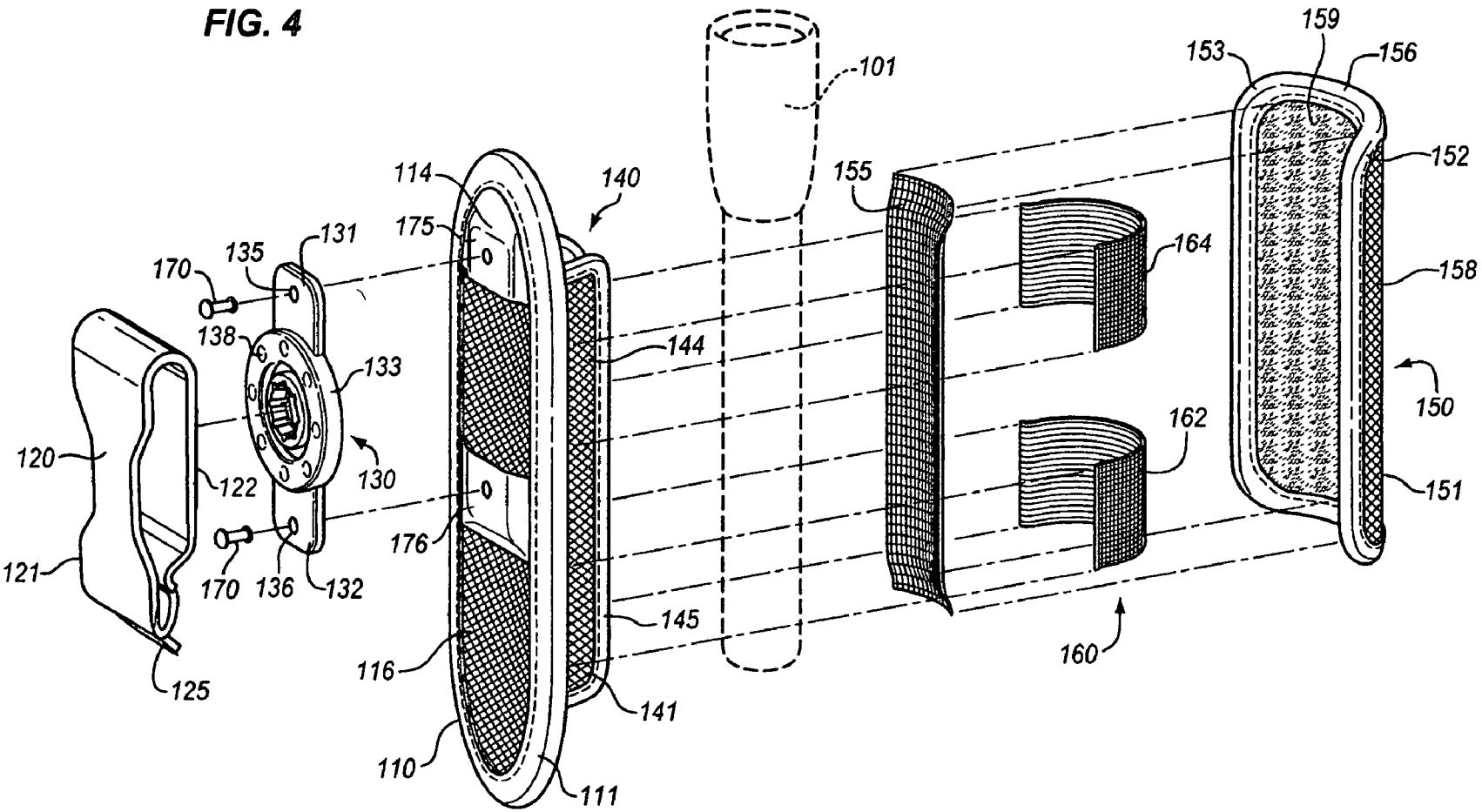
FIG. 4 is a left-rear exploded view of the implement holster of FIG. 1.
Figure 9:
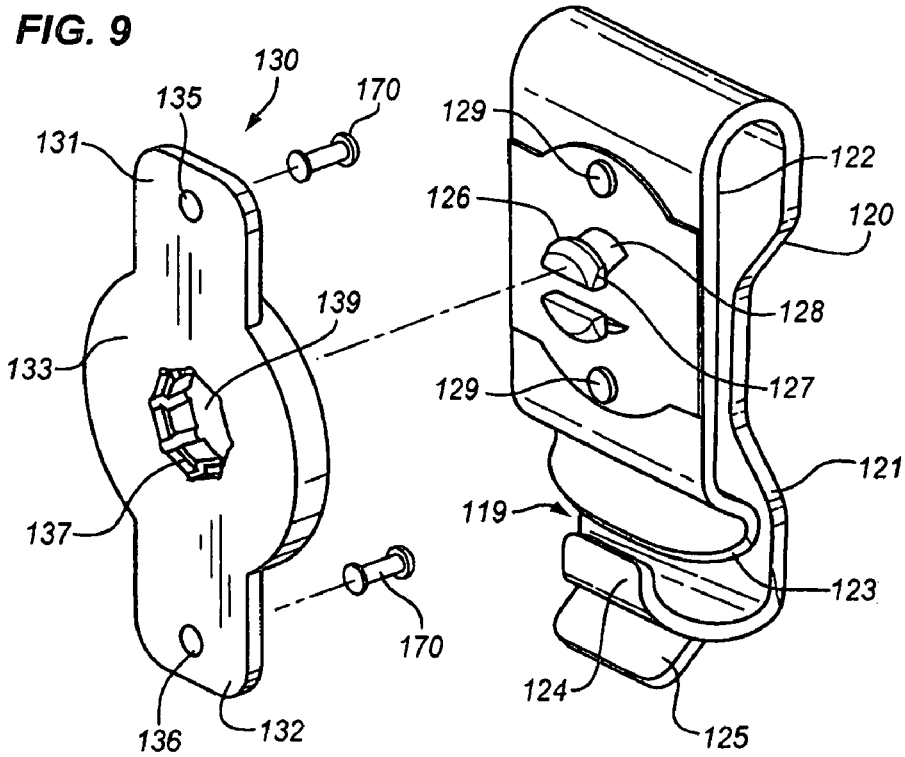
FIG. 9 is a right-side exploded view of a clip and rotator system according to the present invention.
Figure 10:
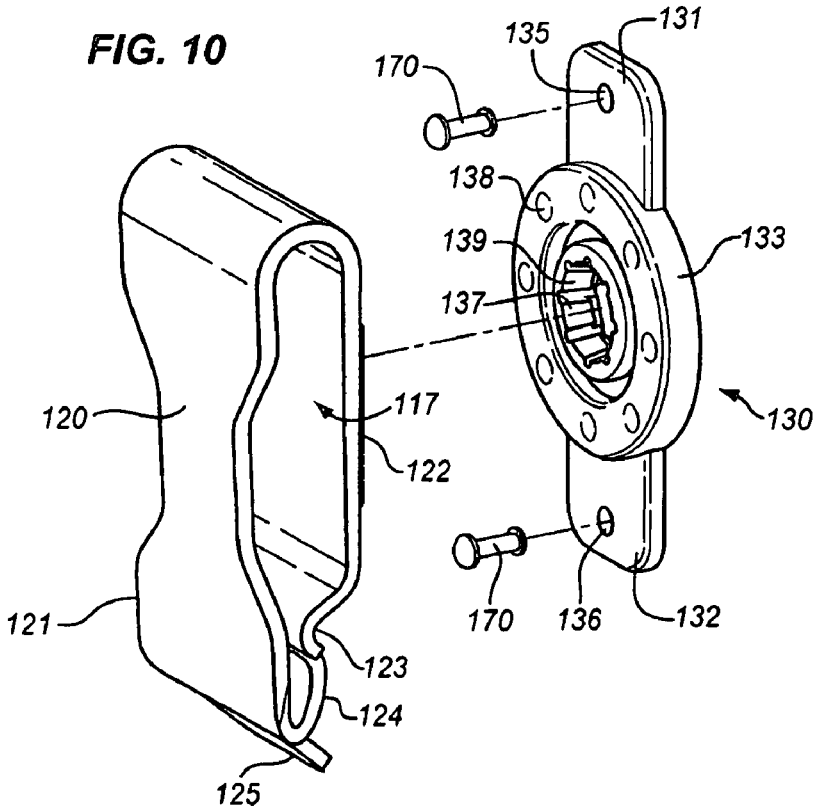
FIG. 10 is a left-side exploded view of the clip and rotator system of FIG. 9.

FIG. 3 is right-front exploded view, and FIG. 4 is a left-rear exploded view of the implement holster. FIG. 5 is top plan view of the implement holster, FIG. 6 is a cross-section of the implement holster taken through the line 6-6 of FIG. 1, and FIG. 7 illustrates the holster with a AAA-cell flashlight inserted with the flashlight in a forward pointing position with respect to the belt clip. FIG. 8 illustrates the holster with a D-cell flashlight inserted with the flashlight pointing upward with respect to the belt clip. FIG. 9 is a right-side exploded view of a clip and rotator system according to the present invention, and FIG. 10 is a left-side exploded view of the clip and rotator system of FIG. 9. FIGS. 9 and 10 provide larger and clearer views of the details of the clip and rotator system shown in FIGS. 3 and 4. Starting from the right in FIG. 3 and the left in FIG. 4, clip 120 preferably comprises an integrally formed resilient member that bends back on itself to form a first side 121 and a second side 122 that enclose a loop area 117 through which a belt 180 (FIG. 7), pants waistband, or other clothing or support member can pass to attach the holster to a person or other object. First side 121 has a clip opening 119 and a catch 123 which nearly closes or closes loop area 117. End 124 curls back to nearly close or close opening 119. Lever tab 125 provides leverage to assist in bending clip 120 to enlarge opening 119 so the clip more easily can be attached or removed to a belt or other object. A pair of prongs 126 and a pair of rounded protrusions 129 extend from first side 121 of clip 120. Each of prongs 126 include a head 127 and a stem 128. Rotator 130 comprises a body member 133, which is preferably a circular plate, and attachment arms 131 and 132. Holes 135 and 136 pass through arms 131 and 132, respectively. Body 133 has an opening 139 for receiving prongs 126. Snap tabs 137 are formed in opening 139. When prongs are pushed through opening 139, tabs 137 snap behind the head 127 of prongs 126 into the groove formed by the fact that a partial cylinder formed by stems 128 has a smaller radius than the partial cylinder formed by the heads 127. Circular plate 133 has dimples 138 formed in it. Preferably, dimples 138 are equally spaced about the circle of the plate, and in the embodiment shown, there are eight dimples. Protrusions 129 on clip back 122 fit into dimples 138 in rotator 130 to form a detent system.

Holster support 110 has a solid core 112 made of a plastic or a metal, preferably made of nylon, a shell 114, preferably molded of a foam plastic, such as EVA, and a cover 116, preferably made of fabric. Preferably, the edges are finished with a fabric binding 118. Fabric straps 175 and 176 are sewn to support 110 to form pockets 178 and 179, into which the arms 131 and 132, respectively, of rotator 130 fit. Bores, such as 177, pass through support 110, and rivets 170 pass through bores 177 and holes 135 and 136 in arms 131 and 132, respectively, to firmly secure rotator 130 to support 110.

Cradle 140 is formed by arms 141 and 142 and the surface 143 of support 110. The fabric 149 (FIG. 3) adjacent to the interior of cradle 140 is preferably a soft, smooth fabric to facilitate sliding implements, such as a flashlight, in and out of the cradle 140 and to protect the surface of the flashlights. Arms 141 and 142 have a structure similar to support 110, including a solid core, a molded shell, a fabric cover 144, and a binding 145, though the core and shell are not shown to avoid confusion in the drawing. The fabric cover 144 of cradle arms 141 and 142 is sewn into the support 110 to form a fabric hinge 146.

Cradle 150 includes arms 151 and 152, which may be separate, but in this embodiment are integrally formed. Cradle 150 also has a layered structure, including solid core 156, shell 154, preferably molded of foam plastic, fabric cover 158, and binding 156. Again, the interior fabric 159 (FIG. 4) of cradle 150 is made of a soft, smooth fabric, while the exterior fabric 151 is a rugged, preferably woven, fabric. Resilient straps 162 and 164 are attached to cradle 150 by a fabric band 155, preferably a strong woven fabric, such as nylon. Fabric band 155 is sewn into binding 156 by stitching 157 (FIG. 6). The ends of the resilient straps 162 and 164 are placed under the binding 118 of support 110 and sewn into the support along with the binding by stitching 166 and 167.

The arms 141 and 142 of the first or inner cradle 140 preferably have a longitudinal length such that the body 103 of the smallest flashlight intended to be held by the holster will extend a small distance out of the distal end of the holster when the head 102 abuts the proximal end of the holster. The arms 141 and 142 have a circumferential length such that when the implement or flashlight has the smallest diameter, such as the AAA-cell flashlight shown in FIGS. 1 and 2, the inner cradle nearly entirely envelopes the flashlight. The arms 141 and 142 of the inner cradle 140 fit within the interior of the second or outer cradle 150. The resilient straps 162 and 164 pull the outer cradle 150 over the arms of the inner cradle 140, forcing them inward to firmly grasp the flashlight 102. The arms 151 and 152 are of such a length that when the D-cell flashlight 106 is inserted (FIG. 8), the resilient straps 162 and 164 are stretched to the point where the flashlight 106 is held by the two cradles. Resilient straps 162 and 164 pull cradle 150 inward, forcing the flashlight 107 into cradle 140, and the straps 162 and 164 also squeeze the arms 141 and 142 of cradle 140 inward to firmly grasp the flashlight 107. Similarly, the flashlight sizes between the AAA-cell and the D-cell are firmly grasped between the two cradles. Thus, all the conventional flashlight sizes can be held firmly by a single holster.

The detent system formed by the protrusions 129 on clip 120 and the dimples 137 on rotator 130 allow the flashlight to be held in any of eight different positions. Thus, when the clip 120 is, for example, held in place on a belt 180 (FIG. 7), the flashlight in the holster can be rotated to any one of eight positions and will remain there. Thus, the flashlight can be aimed at any one of eight different directions and be used hands free.

There has been described an implement holster that will hold a wide variety and sizes of implements. Although this disclosure has been in terms of a flashlight, it should be understood that any tool, instrument, or other implement can be held by the holster. For example, during the test period, it was found to be useful for ammunition and a variety of other implements. It should be understood that the particular embodiments shown in the drawings and described within this specification are for purposes of example and should not be construed to limit the invention, which will be described in the claims below. Further, it is evident that those skilled in the art may now make numerous uses and modifications of the specific embodiment described, without departing from the inventive concepts. For example, cradles of different sizes may be used. The first cradle may be the outer cradle and the second cradle could be the inner cradle. The detents may be formed by putting the dimples on the clip and the protrusions on the rotator. Equivalent structures and processes may be substituted for the various structures and processes described; the subprocesses of the inventive method may, in some instances, be performed in a different order; or a variety of different materials and elements may be used. Consequently, the invention is to be construed as embracing each and every novel feature and novel combination of features present in and/or possessed by the apparatus and methods described.

What is claimed as new and desired to be protected by Letters Patent of the United States is:

1. An implement holster comprising: a holster support, a first cradle attached to the holster support, a second cradle, and a resilient strap system connected between the holster support and the second cradle, the first cradle fitting within the second cradle, wherein said first cradle comprises a first arm and a second arm, said first and second arms attached to said holster support via a hinge and said hinge is a fabric hinge, wherein the first and second arm are surrounded by the resilient strap system, such that the resilient strap system is between the first and second cradle and a fabric band is attached to the second cradle, the fabric band and the second cradle forming a loop around the resilient strap system, and the second cradle is not sewn directly to the first cradle and the second cradle is not part of the same piece of material as the first cradle.

2. An implement holster as in claim 1, and further comprising a clip adapted for attaching said holster to a support.

3. An implement holster as in claim 2, and further comprising a rotator connected between said clip and said holster.

4. An implement holster as in claim 3, and further comprising a detent system permitting said holster to be held in a plurality of different positions with respect to said clip.

5. An implement holster as in claim 2 wherein said clip includes a loop area through which a belt, pants waistband, or other clothing or support member can pass to attach the holster to a person or other object.

6. An implement holster as in claim 1 wherein said second cradle comprises a solid core, a molded shell, and a fabric cover.

7. An implement holster as in claim 6 wherein an interior fabric of said second cradle is made of a soft, smooth fabric, while an exterior fabric of said second cradle is a rugged fabric.

8. An implement holster as in claim 7 wherein said exterior fabric is a woven fabric.

9. An implement holster as in claim 1 wherein said resilient strap system includes a resilient strap connected between said holster support and said second cradle.

10. An implement holster as in claim 9 wherein said resilient strap passes along an outside surface of said first cradle.

11. An implement holster as in claim 1 wherein said first cradle comprises a solid core, a molded shell, and a fabric cover, and said hinge is formed by said fabric cover.

12. An implement holster as in claim 1 wherein said second cradle comprises a first second cradle arm and a second second cradle arm, said first and second arms being connected at their proximal ends; and said resilient strap system comprises a resilient strap connected between said second cradle and said holster support.

13. An implement holster as in claim 1 wherein said holster support comprises a solid core, a molded shell, and a fabric cover.

14. An implement holster as in claim 1 wherein an interior surface of said first cradle is formed out of a soft, smooth fabric.

* * * * *